US006863107B2

(12) United States Patent
Hein et al.

(10) Patent No.: US 6,863,107 B2
(45) Date of Patent: Mar. 8, 2005

(54) DEVICE FOR APPLYING A SPOT EMBOSSING PATTERN TO A WEB OF MULTI-PLY TISSUE PAPER

(75) Inventors: Ferdinand Hein, Mannheim (DE); Harald Harlacher, Mannheim (DE); Joachim Leonhardt, Mannheim (DE)

(73) Assignee: SCA Hygiene Products GmbH, Mannheim (DE)

( * ) Notice: Subject to any disclaimer, the term of this patent is extended or adjusted under 35 U.S.C. 154(b) by 92 days.

(21) Appl. No.: 10/261,620

(22) Filed: Oct. 2, 2002

(65) Prior Publication Data

US 2003/0075262 A1 Apr. 24, 2003

Related U.S. Application Data

(60) Provisional application No. 60/326,186, filed on Oct. 2, 2001.

(51) Int. Cl.[7] ..... B31F 1/07

(52) U.S. Cl. ..... 156/470; 156/459

(58) Field of Search ..... 156/219, 209, 156/459, 470, 443, 582; 162/109, 111, 112; 425/385, 363

(56) References Cited

U.S. PATENT DOCUMENTS

| | | | | |
|---|---|---|---|---|
| 4,325,768 | A | 4/1982 | Schulz | |
| 5,622,734 | A | 4/1997 | Clark et al. | |
| 5,913,765 | A | 6/1999 | Burgess et al. | |
| 2002/0148578 | A1 * | 10/2002 | Reilly et al. | 162/109 |

FOREIGN PATENT DOCUMENTS

| | | |
|---|---|---|
| EP | 0 367 999 A2 | 5/1990 |
| EP | 0 408 248 A2 | 1/1991 |
| EP | 1 074 381 A1 | 2/2001 |
| EP | 1 155 815 A1 | 11/2001 |
| WO | 95/08671 | 3/1995 |
| WO | 99/44814 | 9/1999 |

* cited by examiner

*Primary Examiner*—Blaine Copenheaver
*Assistant Examiner*—Barbara J Musser
(74) *Attorney, Agent, or Firm*—Young & Thompson

(57) ABSTRACT

A device for applying a spot embossing pattern to a web of multi-ply tissue paper being processed in a paper converting machine comprises a marrying roll and a spot embossing unit cooperating and being positioned against the marrying roll. The spot embossing unit comprises a spot embossing roll with a raised embossing pattern on its circumferential surface. The at least two plies of tissue web are combined with a marrying roll and pass between the marrying roll and the spot embossing unit.

15 Claims, 4 Drawing Sheets

DEVICE FOR APPLYING A SPOT EMBOSSING PATTERN TO A WEB OF MULTI-PLY TISSUE PAPER

FIELD OF THE INVENTION

The invention relates to a device and a method for applying a spot embossing pattern to a web of multi-ply tissue paper being processed in a paper converting machine.

TECHNICAL BACKGROUND

There are different possible methods for applying an embossing pattern to tissue paper. The most common are point to point, nested, structural embossing or double embossing random laminate. In each of these cases, the embossing pattern is applied by use of one or more steel rolls in combination with rubber rolls. The rubber rolls have a yielding surface. A raised embossing pattern on the steel roll elastically presses into the rubber roll so that the tissue paper fed between the rubber roll and the steel roll is imparted an embossing pattern. All plies of a multi-ply tissue paper are thus embossed and are normally glued together. Alternatively, it is possible to provide a mechanical ply-bonding by edge-embossing both plies of tissue paper together.

In order to meet customer preferences, many multi-ply tissue paper products are provided with a background embossing pattern and a superimposed spot (motive) embossing pattern. The background pattern which will be denoted microembossing pattern in the following, normally consists of a regular structure of small protuberances in the tissue ply which is formed by small protrusions on an embossing roll which press against and into the tissue ply to be embossed. The spot embossing pattern, on the other hand, mainly consists of larger decor elements which are formed by a superposition over the microembossing pattern.

It is possible to provide embossing rolls in which both the microembossing pattern and the spot embossing pattern are engraved on the circumferential surface. However, if it is desired to change the spot embossing pattern, the whole embossing roll has to be exchanged resulting in rather long changeover times to exchange the rolls having a weight up to several tons. To exchange such a full size embossing roll, the changeover time can be in the range of several working days.

To overcome this problem, it has been proposed to use a separate spot embossing unit for imparting a graphic pattern to a tissue web already provided with a microembossing pattern. Such an additional unit consists of a spot roller having a graphic pattern on its circumferential surface and cooperating with a rubber roller. The additional spot roller has to be driven so that an additional driving unit and drive control are necessary.

FIG. 3 shows a conventional device, as part of a paper converting machine, which has a separate spot embossing device 100 consisting of a steel engraved spot embossing roll 110 and a rubber anvil roll 120. The product 12 already ply-bonded together in a nested configuration passes through this spot embossing device 100 and leaves it as product 12' with an additional spot (motive) embossing.

The prior art device shown in FIG. 3 consists of two microembossing stations which impart a background embossing pattern to the two plies 10, 11 of tissue paper. Each microembossing unit consists of a steel roll 14*a*, 14*b* which cooperates with a rubber roll 16*a*, 16*b*. Between each steel embossing roll and the corresponding rubber roll, a nip is formed through which the plies of tissue paper pass. The steel embossing rolls 14*a*, 14*b* have protrusions 18*a*, 18*b* on their circumferential surface whose height, for an easy understanding of FIG. 3, is not drawn to scale but highly exaggerated. The protrusions 18*a*, 18*b* press into the yielding circumferential surface of the corresponding rubber roll 16*a*, 16*b* so that the ply of tissue paper running through the nip receives an embossing pattern with small protuberances.

In the example shown in FIG. 3, the two steel embossing rolls 14*a*, 14*b* are positioned relative to each other so that the two plies of tissue paper 10, 11 are brought together in a nested configuration. Additionally, the ply 11 of tissue paper receives an adhesive applied by use of the adhesive rolls 22 to that surface which comes into contact with the other ply 10 of tissue paper. After having brought together the two plies 10, 11 in a nested configuration, the combined two ply tissue product 12 passes through the nip between the steel embossing roll 14*b* and a marrying roll 20 in which the two plies are sufficiently pressed together so that the two plies are bonded together. Then, the product 12 leaves this part of the paper converting machine and is passed on to the aforementioned spot embossing device 100 which is operated as a separate unit of the paper converting machine.

SUMMARY OF THE INVENTION

It is the object of the invention to provide a cost effective and variable device and a method for applying a spot embossing pattern to web of multi-ply tissue paper.

The invention resides in that the device for applying a spot embossing pattern to a web of multi-ply tissue paper comprises a marrying roll and a spot embossing unit directly cooperating with the marrying roll and being positioned against it. The spot embossing unit comprises a spot embossing roll with a raised embossing pattern on its circumferential surface. In other words, the spot embossing unit is incorporated in the ply bonding section of the paper converting machine but still provided as a separate unit so that it is easily accessible and easy to change. This provides a high flexibility to satisfy different customers who wish to be provided with different spot designs. Moreover, the rollers are relatively cheap and can be exchanged between different paper converting machines. Since the marrying roll acts as an anvil roll for the spot embossing roll of the spot embossing unit, it serves a double function. This reduces the number of components in the paper converting machine.

According to a preferred embodiment of the invention, the spot embossing unit is rotating freely and driven by the rotation of the marrying roll. This measure further simplifies the device because it is not necessary to provide a driving unit and a control for the driving unit of the spot embossing device.

Preferably, the single plies of tissue paper are individually provided with a microembossing pattern applied by use of steel rollers with embossing protrusions cooperating with rubber anvil rollers. These steel rollers can be rotated in a way so that the microembossing protrusions are circumferentially offset relative to each other. This provides a nested configuration of the combined tissue paper web.

According to a preferred embodiment of the invention, the spot embossing unit comprises one shaft which extends over the full width of the tissue web and carries a single spot embossing roll. In other words, one rotating shaft extending over the full width of the tissue web and having the same length as e.g. the marrying roll, carries an annular spot embossing roll in contact with the marrying roll. The advantage of this embodiment lies in the short changeover time for changing the spot embossing roll. In comparison to the alternative embodiments described below, the provision of one single embossing roll incurs higher costs.

According to an alternative embodiment of the invention, the spot embossing unit comprises a rotating shaft which extends over the full width of the tissue web and carries a plurality of spot embossing rolls. There is one single shaft onto which a plurality of individual spot embossing rolls are arranged. The individual spot embossing rolls can have the shape of short annular rings which are arranged in a longitudinal direction over the single rotating shaft and can be regrouped to realize a plurality of different spot embossing patterns on the tissue web. This embodiment of the spot embossing unit contributes to the high flexibility of the device which requires only short changeover times and, by use of low cost spot embossing rolls, can be specifically adapted to the customers' needs. Moreover, the provision of single spot embossing rolls enables a flexible adaption to desired production quantities. If a certain number of product webs are cut from the tissue web, two or more different design patterns can be produced at the same time. The inventive spot embossing unit enables a quick adjustment of the production output by changing the number of individual ring-like spot embossing roll which are used on one single rotating shaft.

Alternatively, the spot embossing unit comprises a plurality of individual spot embossing rolls each of which are carried by individual shafts. This alternative system even increases the flexibility of the spot embossing unit. If it is desired to change the distribution of design bands on the tissue paper web, it is no longer necessary to remove the individual spot embossing rolls from the full-length rotating shaft and to bead the desired spot embossing rolls again onto the shaft. A single spot embossing roll can easily be exchanged simply by removing and exchanging it.

In order to achieve the above discussed advantages of a high production flexibility, the width of the spot embossing rolls should correspond to the breadth of the product webs to be cut from the tissue web. This corresponds to the width of the finished product.

According to a preferred embodiment of the invention, the spot embossing unit is removably mounted to a machine frame of a paper converting machine. This further increases the flexibility of the spot embossing unit, because it can be easily shifted from one paper converting machine to another one.

According to a preferred embodiment of the inventive method, the plies of tissue web are adhesively bonded at the spot embossing protuberances. Then, the marrying roll should be slightly spaced from its cooperating steel embossing roll so that the microembossing pattern does not contribute to the adhesive ply bonding between the two plies. Only the spot design sufficiently presses the two plies together so that the adhesive ply bonding of the two tissue webs occurs only at the protuberances of the spot embossing pattern. However, it should be borne in mind that in this embodiment, the marrying roll can no longer be passively rotated by contact with the corresponding steel embossing roll. Instead, the marrying roll has to be driven.

BRIEF DESCRIPTION OF THE DRAWINGS

In the following, a preferred embodiment of the invention will be described with reference to accompanying drawings. In the drawings.

DETAILED DESCRIPTION OF A PREFERRED EMBODIMENTS

Figure 1:
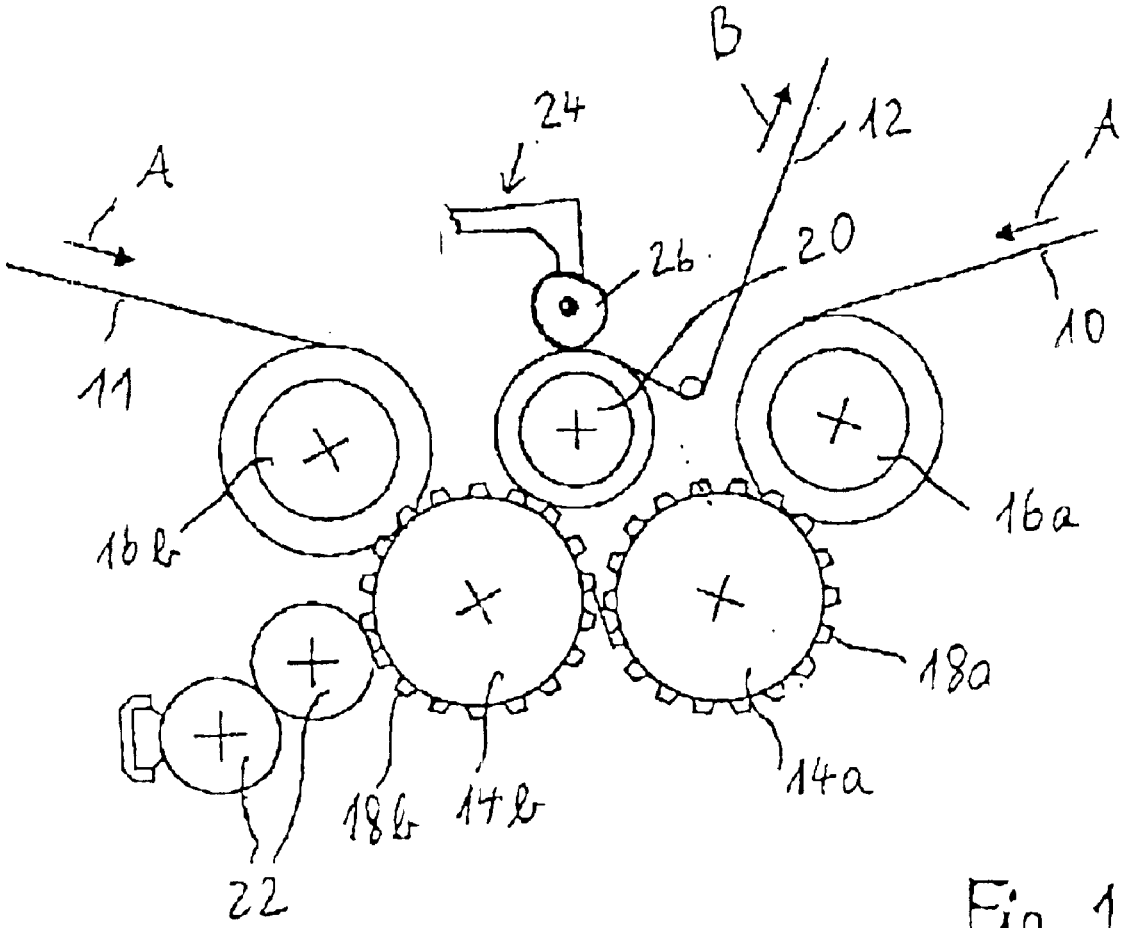
FIG. 1 is a schematic view of the inventive spot embossing unit and its position within a paper converting machine.

In the following description, identical or similar elements will be designated throughout the Figs. with the same reference numerals.

FIG. 1 schematically shows the position of a spot embossing unit within a paper converting machine. Although there are two plies of tissue paper in the example shown, it should be apparent to those skilled in the art that the multi-ply tissue paper to be processed in the inventive device might consist of more than two plies of tissue paper.

The two plies 10, 11 of tissue paper are fed in the direction of arrow A and pass through the nip between rubber rolls 16*a*, 16*b* and corresponding steel embossing rolls 14*a*, 14*b*. The steel embossing rolls 14*a*, 14*b* are driven and in registration with each other such that the microembossing protrusions 18*a*, 18*b* on their peripheral surface apply a microembossing pattern of small protuberances to the tissue webs 10, 11 such that these two plies can be brought together in a nested configuration. The rubber rollers 16*a*, 16*b* are rotated together with the steel embossing rollers because of their frictional contact with them.

The two plies of micro embossed tissue paper are combined together and pass through the nip between a marrying roll 20 and the steel embossing roll 14*b*. The tissue web 11 running around the steel embossing roll 14*b* is additionally provided with an adhesive layer on that surface which is supplied in the usually known manner by means of adhesive applying rolls 22. Before the two-ply tissue paper web leaves the part of the paper converting machine in the direction of arrow B, a spot embossing is applied by means of the schematically shown spot embossing unit 24. This spot embossing unit 24 is mounted to the machine frame of the paper converting machine and comprises a spot embossing roll 26 forming a nip with the marrying roll 20. The combined two ply tissue paper passes through the nip between the spot embossing roll 26 and the marrying roll 20.

As can be derived from the schematic drawing of FIG. 1, the spot embossing roll 26 has a considerably smaller diameter compared to the steel embossing rolls 14*a* and 14*b*. Moreover, the spot embossing unit 24 is directly attached to the machine frame. Therefore, it is possible to dismount the spot embossing unit 24 and to replace it by a different one or to shift it to another paper converting machine.

The spot embossing roll has spot protrusions (not depicted in FIG. 1) which provide a design pattern on the tissue web 12 in the nip between the spot embossing roll 26 and the marrying roll 20. Therefore, the spot embossing will become superposed on the microembossing pattern.

The spot embossing roll can be provided as a single roll which extends over the whole length of the tissue web to be processed. In other words, according to this embodiment the spot embossing roll 26 has the same length as the marrying roll 20. The advantage of this embodiment lies in the easy exchangeability of the spot embossing roll so that it can easily be replaced by another spot embossing roll which shows another design.

Another possibility is to provide a spot embossing unit comprising a plurality of spot embossing rolls which are arranged relative to each other in the direction of their rotational axis, resulting in the possibility to change the individual spot embossing patterns guide easily. The individual rings 28*a*, 28*b* . . . 28*n* can each have the same spot embossing pattern or different ones. The individual spot embossing rolls 28 are interposed in an freely selectable pattern between the edge rolls 30 arranged at the longitudinal sides of the spot embossing unit. The edge rolls 30 are positioned in that peripheral region of the tissue web which are trimmed along the longitudinal edges of the tissue web. The width a of the individual spot embossing rolls is chosen so that it corresponds to the breadth of the product webs to be cut from the tissue web. For example, in the case of toilet paper to be produced, the width of the individual spot embossing rolls corresponds to that of the toilet paper rolls. Therefore, the individual rolls can be provided with different design patterns which are specifically selected according to production requirements or the customers' requests.

Figure 2A:
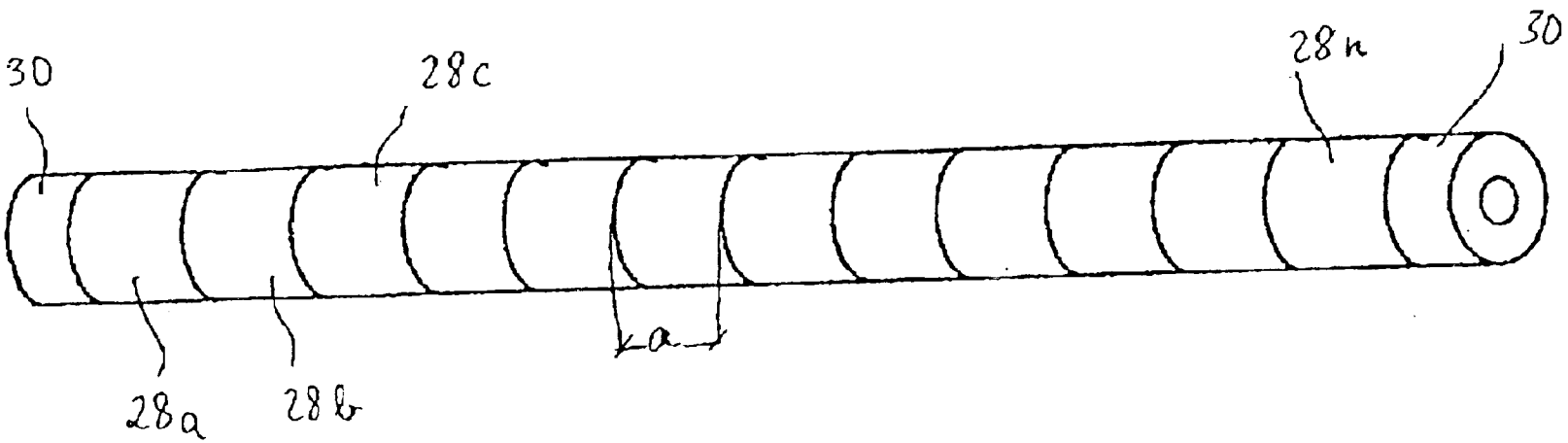
FIG. 2*a* schematically shows one example of a possible arrangement of a plurality of individual spot embossing rolls onto one single shaft.

The schematically shown group of individual spot embossing rolls shown in FIG. 2*a* can be mounted onto one single rotating shaft. Preferably, the individual spot embossing rolls 28 are secured to the rotating shaft by means of a key connection so that they are fixed in a rotational direction of the shaft. In the same way, a movement of the individual rolls in a longitudinal direction of the shaft can be prevented by the provision of suitable abutment elements which are in contact with the edge rolls 30.

The advantage of the embodiment according to FIG. 2*a* lies in its high flexibility with regard to the grouping of the individual spot embossing rolls 28 on the rotating shaft of the spot embossing unit. Moreover, it is easily possible to transfer the spot embossing unit to another production line without having to handle the individual spot embossing rolls. However, a disadvantage lies in the need to dismount the whole assembly of spot embossing rolls if one specific roll somewhere in the middle of the shaft has to be changed.

Figure 2B:
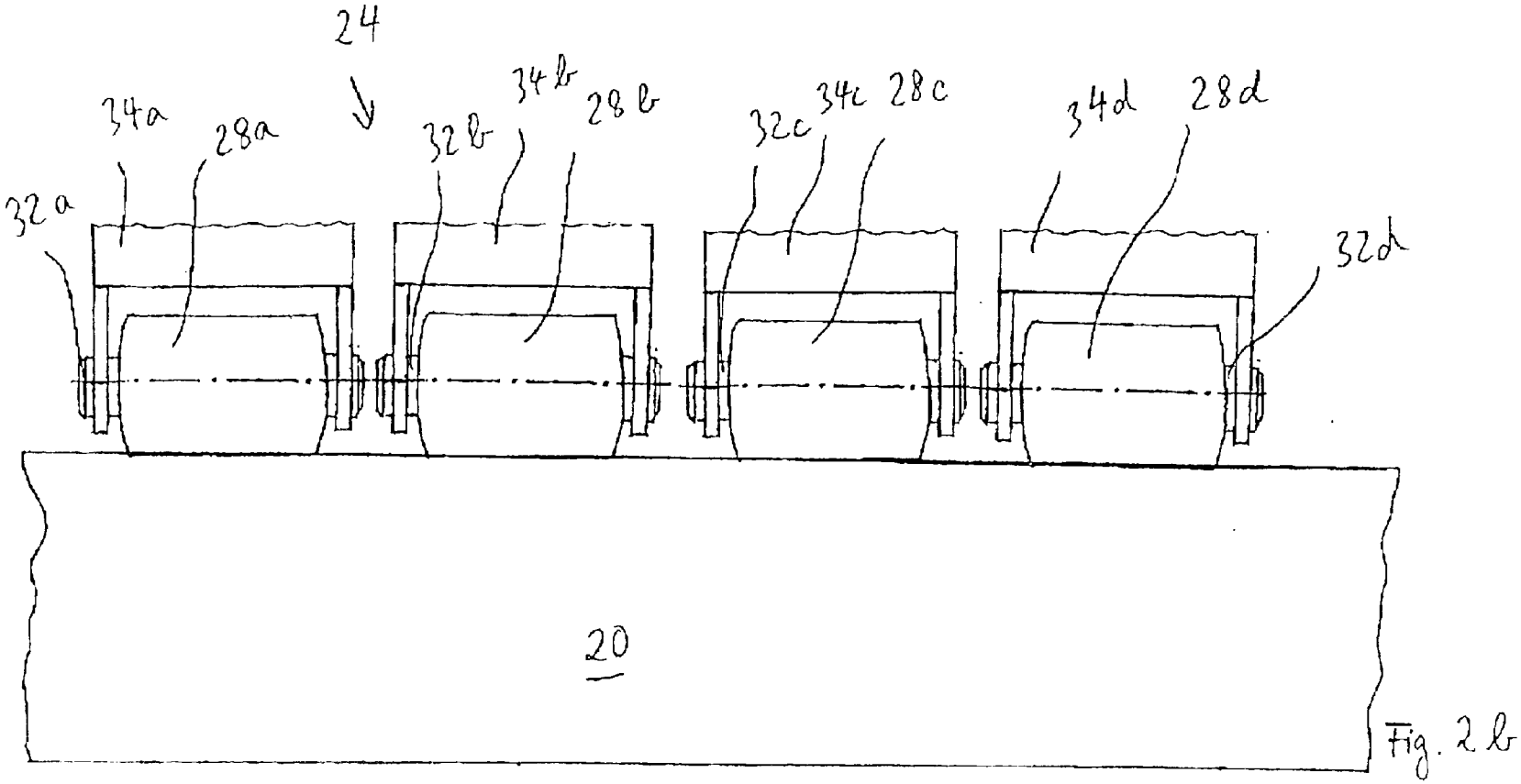
FIG. 2*b* schematically shows an alternative embodiment with a plurality of rotating shafts for the individual spot embossing rolls.
Figure 3:
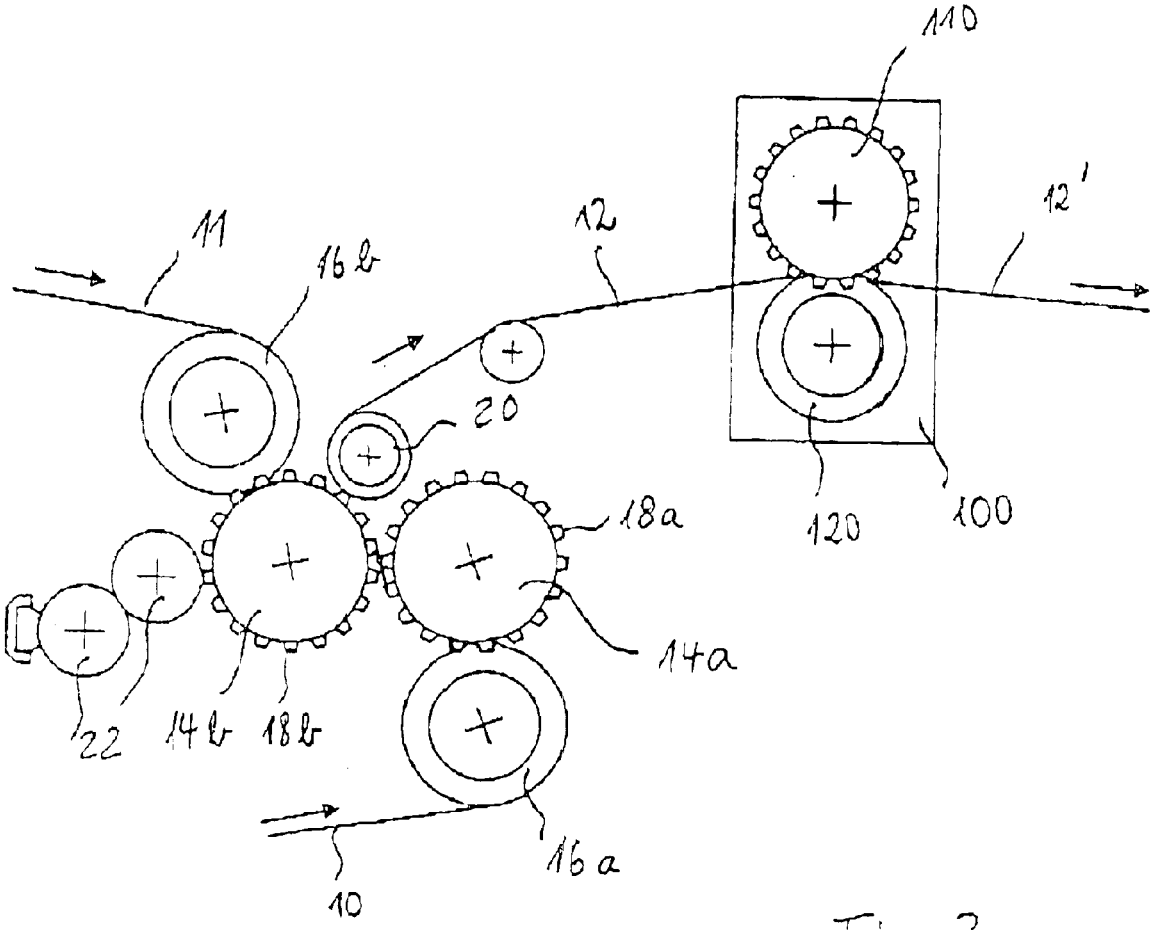
Fig. 3 Prior Art
FIG. 3 schematically shows the provision of an individual spot embossing unit in a prior art device.

To avoid this disadvantage, it is also possible to use a spot embossing unit like that schematically shown in FIG. 2*b*. The spot embossing unit comprises individual spot embossing rolls 28*a* to 28*d*, only four of which are shown by way of example. Each of the spot embossing rolls 28*a* to 28*d* are provided on an individual rotating shaft 32*a* to 32*d* which is rotatably supported by individual brackets 34*a* to 34*d* of the spot embossing unit 24. The brackets can be individually urged in contact with the marrying roll 20. With the structure according to FIG. 2*b* it is possible to exchange individual spot embossing rolls without having to dismount the other spot embossing rolls. This reduces the changeover time for changes in the configuration of the spot embossing unit and further contributes to an increased flexibility of the inventive spot embossing unit.

The inventive constructions provides a high flexibility of the system. Contrary to the embodiment described in FIG. 1, it is also possible to provide a gap between the marrying roll 20 and the steel embossing roll 14*b*. In that case, the two plies of tissue paper are adhesively bonded only at the spot embossing unit. However, in that case, the marrying roll 20 is no longer driven by the frictional contact with the steel embossing roll 14*b* so that it has to be individually driven.

The inventive spot embossing unit provides a high flexibility so that different spot designs can be combined with different microembossing pattern, product types, product parameters and product specifications. Any change of the spot embossing unit can be performed in relative short changeover times so that any variations can be easily performed.

What is claimed is:

1. A device for embossing a web of multi-ply tissue paper, comprising:

a first roll having embossing protrusions;

a second roll cooperating with said first roll to form a first nip;

a marrying roll cooperating with said first roll to form a second nip; and a spot embossing roll having a raised embossing pattern on a circumferential surface and cooperating with said marrying roll to form a third nip.

2. The device as claimed in claim 1, wherein the first roll is steel and the second roll is rubber.

3. The device as claimed in claim 1, wherein there are a plurality of said first rolls cooperating with a respective one of a plurality of said second rolls.

4. The device as claimed in claim 3, wherein a plurality of plies of tissue paper are individually provided with a microembossing pattern applied by a respective one of said plural first rolls cooperating with a respective one of said plural second rolls.

5. Device for embossing a web of multi-ply tissue paper being processed in a paper converting machine, comprising:

a steel roll with embossing protrusions;

a rubber anvil roll cooperating with said steel roll;

a marrying roll cooperating with said steel roll to bond together plies of tissue paper; and a spot embossing unit cooperating with and being positioned against the marrying roll; wherein the spot embossing unit comprises a spot embossing roll with a raised embossing pattern on its circumferential surface, said spot embossing roll forms a nip with said marrying roll.

6. Device according to claim 5, wherein the spot embossing unit is freely rotating and is driven by frictional contact with the marrying roll.

7. Device according to claim 5, wherein single plies of tissue paper are individually provided with a microembossing pattern applied by said steel roll cooperating with said rubber anvil roll.

8. Device according to claim 7, wherein two plies of micro embossed tissue web are combined in a nested configuration.

9. Device according to claim 5, wherein the spot embossing unit comprises one shaft which extends over the full width of the tissue web and carries a single spot embossing roll.

10. Device according to claim 5, wherein the spot embossing unit comprises a rotating shaft which extends over the full width of the tissue web and carries a plurality of spot embossing rolls.

11. Device according to claim 5, wherein the spot embossing unit comprises a plurality of individual spot embossing rolls which are carried by individual shafts.

12. Device according to claim 10, wherein the width of the spot embossing rolls corresponds to the breadth of product webs to be cut from the web of multi-ply tissue paper.

13. Device according to claim 11, wherein the width of the spot embossing rolls corresponds to the breadth of product webs to be cut from the web of multi-ply tissue paper.

14. Device according to claim 5, wherein the spot embossing unit is removably mounted to a machine frame of paper converting machine.

15. Device according to claim 5, wherein the marrying roll combines at least two plies of tissue web.

* * * * *